United States Patent [19]

Paton et al.

[11] 4,229,216

[45] Oct. 21, 1980

[54] TITANIUM BASE ALLOY

[75] Inventors: Neil E. Paton, Thousand Oaks; Cecil G. Rhodes, Simi Valley, both of Calif.

[73] Assignee: Rockwell International Corporation, El Segundo, Calif.

[21] Appl. No.: 13,992

[22] Filed: Feb. 22, 1979

[51] Int. Cl.[2] ..... C22C 14/00

[52] U.S. Cl. ..... 75/175.5; 148/133

[58] Field of Search ..... 75/175.5; 148/32, 32.5, 148/133

[56] References Cited

U.S. PATENT DOCUMENTS

| | | | |
|---|---|---|---|
| 2,777,768 | 1/1957 | Busch et al. | 75/175.5 |
| 2,810,643 | 10/1957 | Methe | 75/175.5 |
| 2,880,087 | 3/1959 | Jaffee et al. | 75/175.5 |
| 2,892,705 | 6/1959 | Jaffee et al. | 75/175.5 |
| 2,893,864 | 7/1959 | Harris et al. | 75/175.5 |
| 2,899,303 | 8/1959 | Busch et al. | 75/175.5 |
| 3,194,693 | 7/1965 | Soltis | 148/13 |
| 3,262,778 | 7/1966 | Kaarlela | 75/175.5 |
| 3,378,368 | 4/1968 | Minton | 75/175.5 |
| 3,619,184 | 11/1971 | Bomberger, Jr. et al. | 75/175.5 |
| 3,756,810 | 9/1973 | Parris | 75/175.5 |
| 3,833,363 | 9/1974 | Bomberger, Jr. | 75/175.5 |
| 4,087,292 | 5/1978 | Neal et al. | 75/175.5 |
| 4,094,708 | 6/1978 | Hubbard et al. | 75/175.5 |

FOREIGN PATENT DOCUMENTS

| | | | |
|---|---|---|---|
| 652000 | 11/1962 | Canada | 75/175.5 |
| 1179006 | 10/1964 | Fed. Rep. of Germany | 75/175.5 |
| 1267793 | 6/1961 | France | 75/175.5 |
| 120328 | 12/1958 | U.S.S.R. | 75/175.5 |
| 451766 | 3/1975 | U.S.S.R. | 75/175.5 |
| 473757 | 10/1975 | U.S.S.R. | 75/175.5 |

*Primary Examiner*—L. Dewayne Rutledge
*Assistant Examiner*—Peter K. Skiff
*Attorney, Agent, or Firm*—L. Lee Humphries; Craig O. Malin

[57] ABSTRACT

A predominately $\alpha$-phase titanium base alloy having good high temperature creep strength. The alloy has about 8% aluminum to promote a strengthening $\alpha_2$ precipitate, and about 5% columbium to ductilize the $\alpha_2$ precipitate. Additionally, the alloy has about 5% zirconium, up to 0.5% silicon, up to 2% tin, and up to about 1.5% molybdenum.

4 Claims, 1 Drawing Figure

TITANIUM BASE ALLOY

BACKGROUND OF THE INVENTION

1. Field of the Invention

This invention relates to the field of metallurgy and particularly to the field of titanium base alloys for high temperature applications.

2. Description of the Prior Art

Alpha phase alloys of titanium are known to retain strength at high temperatures. Two of the strongest high temperature creep resistant alpha phase alloys presently available are known commercially as IMI 685 and Ti-11. Both these alloys have a nominal aluminum content of 6% and a creep rate of about 0.1% per hour at a stress of 40,000 psi and at a temperature of 1000° F.

To increase the performance of jet aircraft, there is an ever present need to improve the strength and creep resistance of high temperature titanium alloys. Therefore, metallurgists have added increasing amounts of alloy elements (particularly aluminum) to titanium in order to increase the strength. However, when the aluminum content exceeds 6% an ordered precipitate of $Ti_3Al$ generally called $\alpha_2$ is formed. The $\alpha_2$ precipitate causes a loss ductility of these alloys. Such problem is well documented in U.S. Pat. No. 2,892,705 to R. I. Jaffee, et al., covering a Ti-(3-6)Al-(4-15)Zr alpha phase titanium alloy and a Ti-(3-6)Al-(4-10)Sn-(5-10)Zr alpha phase titanium alloy.

Consequently, prior art alpha phase titanium alloys have generally been limited to a maximum of about 6% aluminum. This limitation in turn has limited the strength obtainable in such alloys.

SUMMARY OF THE INVENTION

It is an object of the invention to provide a titanium alloy having increased strength.

It is an object of the invention to provide a predominately alpha phase titanium alloy having increased strength at high temperatures.

It is an object of the invention to provide a predominately alpha phase titanium alloy having increased creep strength at high temperatures.

It is an object of the invention to provide a predominately alpha phase titanium alloy having high creep strength and useable ductility at high temperatures.

According to the invention, the alpha phase alloy contains about 8% aluminum in order to create a strengthening $\alpha_2$ precipitate and about 5% columbium to ductilize the $\alpha_2$ precipitate. The alloy also includes about 5% zirconium to promote uniform silicide precipitation and up to 0.5% silicon to provide creep strength. The resulting alloy has a creep rate of less than 0.1% per hour at 1000° F. and at a stress of 70,000 psi while still having sufficient ductility to be useable.

These and other objects and features of the present invention will be apparent from the following detailed description, taken with reference to the accompanying drawing.

DESCRIPTION OF THE PREFERRED EMBODIMENT

Figure 1:
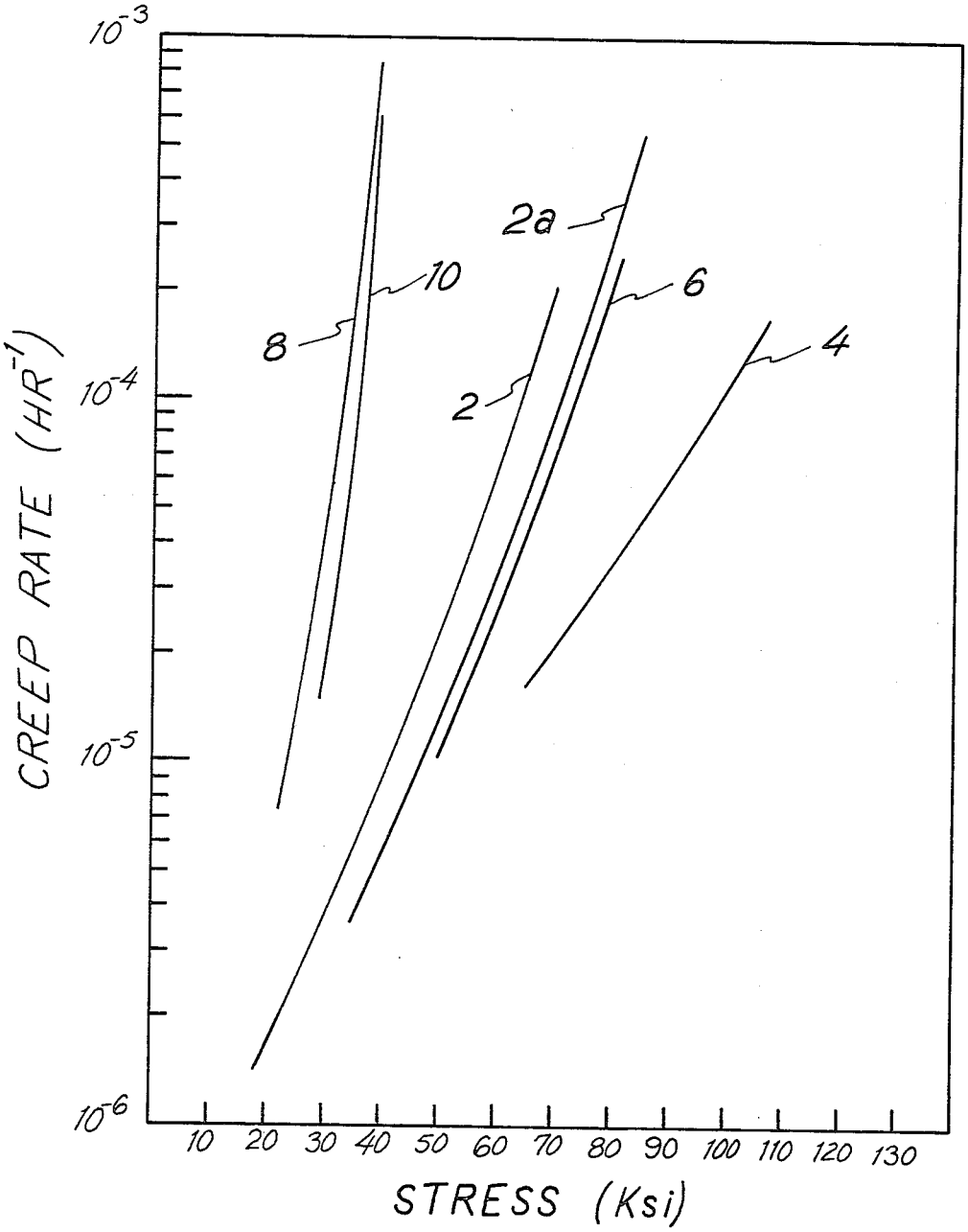
FIG. 1 is a graph of creep rate vs stress at 1000° F. for two prior art alloys and for the alloy of the present invention with different silicon contents.

The basic composition of the alloy of the present invention is 8% Al, 5% Zr, 5% Cb, and balance titanium (all in weight %). The 8% Al provides high strength and forms an $\alpha_2$ precipitate which is known to occur in titanium alloys with aluminum contents greater than about 6%. The $\alpha_2$ precipitate is a $Ti_3Al$ ordered compound which precipitates throughout the $\alpha$ matrix when a titanium alloy of suitable composition is aged in the range of about 1100° F. to 1400° F. While it is recognized that the $\alpha_2$ precipitate can be used to strengthen an $\alpha$ phase titanium alloy, it has been avoided as a strengthening phase because it greatly lowers the ductility of the alloy and makes the material too brittle to be of general practical use. This is a phenomenon frequently called "ordering embrittlement."

In work leading to the present invention, it was discovered that a relatively high addition, i.e. 5%, of columbium resulted in an alloy with useable dutility despite the high aluminum content and the formation of the $\alpha_2$ precipitate. Although columbium has been used in alpha phase titanium alloys, it has been used primarily as a solute element to strengthen the alpha phase. Since it is alpha soluble up to only about 3%, it has generally not been used in such alloys and for such a purpose in excess of 3%. Additionally, columbium has been kept relatively low in alpha phase alloys because it is a beta phase stabilizer. Large amounts of columbium tend to promote the beta phase thus creating a two phase, alpha-beta, alloy rather than a single alpha phase alloy. However, the 5% columbium utilized in the alloy of the present invention does not cause the formation of beta phase, and the alloy is predominantly alpha phase for all compositions within its claimed chemical range. Thus, an important feature of the present invention is the utilization of a high aluminum content to strengthen the alloy and a high columbium content to provide ductility despite the ordering embrittlement associated with aluminum contents greater than 6%.

Zirconium serves to strengthen the alpha phase, and when silicon is present promotes a uniform silicide precipitate. Although not an essential ingredient in the alloy, silicon may be utilized in amounts of from 0 to 0.50% to improve the high temperature creep strength.

Table I shows the composition of three alloys 2, 4, 6 according to the invention with varying amounts of silicon added to the basic composition of 8% Al, 5% Zr, and 5% Cb. Also included for comparison are the compositions of two predominately alpha alloys 8, 10 that are known to have high creep rupture strength.

TABLE I

COMPOSITIONS OF $\alpha$-PHASE ALLOYS

| Alloy Reference # | Al | Zr | Cb | Mo | Sn | Bi | Si | Ti |
|---|---|---|---|---|---|---|---|---|
| 2 and 2a | 8 | 5 | 5 | | | | | Bal |
| 4 | 8 | 5 | 5 | | | | 0.25 | Bal |
| 6 | 8 | 5 | 5 | | | | 0.50 | Bal |
| 8 (IMI 685, prior art) | 6 | 5 | | 0.5 | | | 0.35 | Bal |
| 10 (Ti-11, prior art) | 6 | 1.5 | | 1.0 | 2 | 0.35 | 0.1 | Bal |

The test bars for alloys shown in Table I and in FIG. 1 were fabricated by hot rolling ingots into ½-inch rounds, machining the rounds into test bars, and then solution treating the test bars at 2000° F. to 2200° F. In addition to the solution treatment, sample 2a was aged at 1200° F. for 48 hours prior to creep testing.

Standard room temperature tensile tests were also run on alloys 2, 2a, 4, 6 to determine the room temperature strength and ductility (% elongation) of the material. These results are shown in Table II. Elongation is sufficiently high for many practical applications. The aged alloy without silicon, 2a, has higher strength and lower elongation than the corresponding unaged alloy 2.

In FIG. 1, the creep rates at various stresses are plotted for the alloys 2, 2a, 4, 6, 8, 10 shown in Table I. For the same creep rate, the operating stress of alloys 2, 2a, 4, 6 of the invention are almost two to three times higher than for the prior art alloys 8, 10. For example, at a creep rate of $10^{-4}$ per Hr (0.01%), the prior art alloys 8, 10 can sustain a stress of about 35,000 psi, whereas alloys 2, 4, 6 of the present invention can sustain a stress of over 65,000 psi.

TABLE II

| | ROOM TEMPERATURE TENSILE TEST RESULTS | | | | |
|---|---|---|---|---|---|
| Alloy Reference # | % Si | Heat Treatment | .2% Yield Strength-ksi | Ultimate Strength - ksi | Elongation % |
| 2 | — | Solution Treat | 111.6 | 134.2 | 9.9 |
| 2a | — | Solution Treat + age | 128.6 | 142.7 | 5.0 |
| 4 | .25 | Solution Treat | 136.7 | 165.2 | 6.9 |
| 6 | .50 | Solution Treat | 145.3 | 17.09 | 3.6 |

The microstructure of alloys 2, 2a, 4, 6 were evaluated both before creep testing and after creep testing. The solution treated material has a single phase, martensitic alpha phase microstructure. If this material is then aged at 1200° F. for 48 hours, $\alpha_2$ particles about 100 Å in size are formed in the alpha phase matrix. For the silicon-containing alloys 4, 6, aging also produces inter- and intra-granular silicides.

The microstructure after creep testing is about the same as before creep testing for material which has been solution treated and aged. However, for material which has only been solution treated, the post-creep microstructure shows particles of $\alpha_2$ resulting from aging during the 1000° F. testing. The size of these creep-aged $\alpha_2$ particles is only about 20 Å rather than 100 Å as in the material aged before creep testing.

The nominal composition of the alloy according to the invention is: 8% Al, 5% Zr, 5% Cb, and balance Ti with minor impurities. In a preferred embodiment the alloy can contain up to 0.50% Si. Additionally, the alloying elements can be varied from the nominal composition in order to provide a composition range within which the melter can produce acceptable material. In the present alloy, a practical composition range is: 7.5 to 12% Al; 4 to 10% Zr, 4 to 7% Cb and balance Ti plus minor impurities.

In the embodiments containing silicon, the amount of silicon can be varied within the range of 0.05 to 0.50 Si. Of course, the composition limits can be narrowed within the skill of the artisan to produce alloys meeting tighter specification requirements.

It is well known that Sn, an alpha stabilizer, strengthens the alpha phase in solid solution. Tin can be added to the alloy in amounts up to 2% to provide further strengthening of the alloy. It is also well known that small amounts of Mo added to alpha Ti alloys can reduce the grain size or the martensite plate size. The microstructure refinement provided by Mo has been shown to be beneficial to creep resistance. Molybdenum can be added to the alloy in amounts up to 1.5% to refine the alpha grain size or martensite plate size to provide additional creep resistance.

Numerous variations and modifications may be made without departing from the present invention. Accordingly, it should be clearly understood that the form of the present invention described above and shown in the accompanying drawings is illustrative only and is not intended to limit the scope of the present invention.

What is claimed is:

1. A titanium base alloy consisting essentially of about 7.5 to 12% aluminum, about 4 to 10% zirconium, about 4 to 7% columbium, up to about 0.5% silicon, and balance titanium and impurities.

2. A titanium base alloy consisting essentially of about 7.5 to 12% aluminum, about 4 to 10% Zr, about 4 to 7% columbium, and balance titanium and impurities.

3. A titanium base alloy having a nominal composition of 8% Al, 5% Zr, 5% Cb, and balance Ti.

4. A titanium base alloy consisting essentially of about 7.5 to 12% aluminum, about 4 to 10% zirconium, about 4 to 7% columbium, up to about 0.5% silicon, up to about 2% tin, up to about 1.5% molybdenum, and balance titanium and impurities.

* * * * *